US006946059B2

(12) United States Patent
Mohrsen et al.

(10) Patent No.: US 6,946,059 B2
(45) Date of Patent: Sep. 20, 2005

(54) THREADING ARM ASSEMBLY FOR A PAPER MACHINE

(75) Inventors: Leif Mohrsen, Surrey (GB); John Eagle, Cheshire (GB)

(73) Assignee: Voith Paper Patent GmbH, Heidenheim (DE)

( * ) Notice: Subject to any disclaimer, the term of this patent is extended or adjusted under 35 U.S.C. 154(b) by 5 days.

(21) Appl. No.: 10/278,296

(22) Filed: Oct. 23, 2002

(65) Prior Publication Data

US 2004/0079506 A1 Apr. 29, 2004

(51) Int. Cl.[7] ..... D21F 7/04

(52) U.S. Cl. ..... 162/255; 162/193; 226/92; 226/12; 226/91; 226/172

(58) Field of Search ..... 162/255, 193; 226/92, 12, 91, 172

(56) References Cited

U.S. PATENT DOCUMENTS 6,387,220 B1 * 5/2002 Mohrsen et al. ..... 162/363

* cited by examiner

*Primary Examiner*—Mark Halpern
(74) *Attorney, Agent, or Firm*—Taylor & Aust, P.C.

(57) ABSTRACT

A paper machine for manufacturing a fiber web traveling in a machine direction and having a tail includes at least one rope defining a rope nip. A threading arm assembly is positioned in association with the rope nip. The threading arm includes a frame and a diverter carried by the frame. The diverter is movable to divert the tail in a direction transverse to the machine direction toward the rope nip.

19 Claims, 3 Drawing Sheets

THREADING ARM ASSEMBLY FOR A PAPER MACHINE

BACKGROUND OF THE INVENTION

1. Field of the Invention

The present invention relates to paper machines, and, more particularly, to devices for threading a fiber web tail in a paper machine.

2. Description of the Related Art

During startup of a paper machine, or following a web break, a narrow edge strip of the fiber web (called a tail) is typically guided along a web travel path through the dry end of the machine. Blast nozzles pointing in the machine direction may be used to transfer the tail through the machine. The air jets produced by the blast nozzles drive the tail in the desired direction through the machine. This process is known as "threading" the machine.

It is known to provide a rope guide arrangement whereby two points converge in a so called rope nip at the beginning of the rope guide arrangement. The tail is led into the rope nip which is located in a pick up area and is held between the ropes. The tail is carried together with the ropes along the web travel path into a transfer area in which the tail is transferred to a downstream unit in the machine.

Occasionally, the tail may not align with the rope nip defined by the rope guide arrangement. It is sometimes necessary to manually feed the tail into the rope nip for threading of the machine. Not only is this time consuming, but it is also desirable to avoid inserting hands and arms into the machine area whenever possible.

What is needed in the art is a device which not only threads a fiber web tail in a machine direction, but also is capable of diverting the fiber web tail in a direction transverse to the machine direction.

SUMMARY OF THE INVENTION

The present invention provides a threading arm assembly which diverts a fiber web tail laterally (with respect to the machine direction).

The invention comprises, in one form thereof, a paper machine for manufacturing a fiber web traveling in a machine direction and having a tail. At least one rope defines a rope nip. A threading arm assembly is positioned in association with the rope nip. The threading arm assembly includes a frame and a diverter carried by the frame. The diverter is movable to divert the tail in a direction transverse to the machine direction toward the rope nip.

The invention comprises, in another form thereof, a threading arm assembly for threading a fiber web tail. The threading arm assembly includes a frame having a mounting, and a diverter carried by the frame. The diverter is movable generally toward the mounting for diverting the fiber web tail generally toward the mounting.

An advantage of the present invention is that the fiber web tail can be diverted laterally into a rope nip associated with a dryer section.

Another advantage is that the diverter can be provided with an air cushion so as not to directly contact the fiber web tail.

Yet another advantage is that the diverter can be operated either manually or automatically.

Still another advantage is that the threading arm assembly of the present invention can be retrofitted to existing machines.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
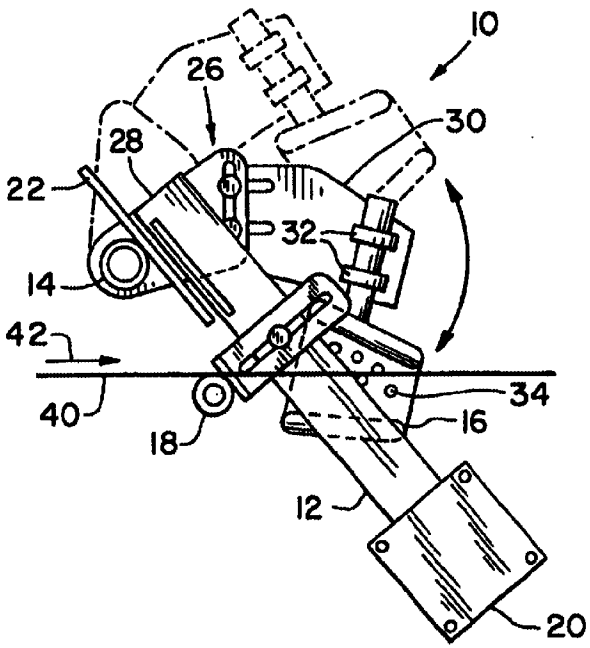
FIG. 2 is a side view of the threading arm assembly of FIG. 1.
Figure 1:
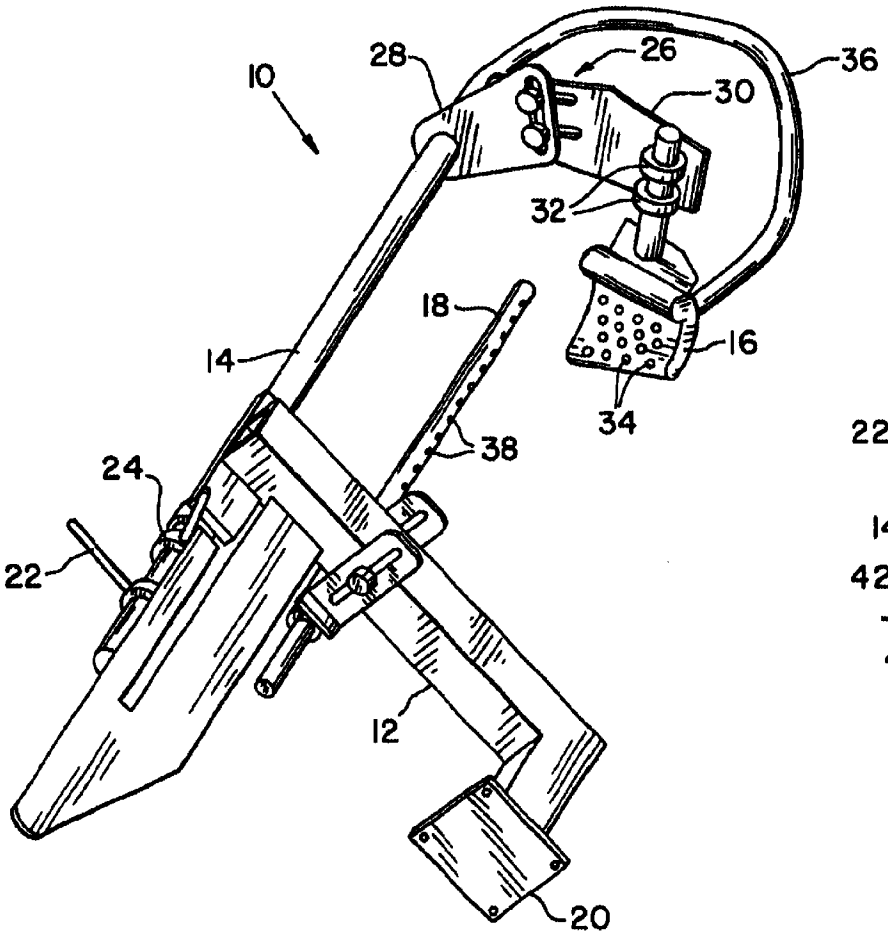
FIG. 1 is a perspective view of an embodiment of a threading arm assembly of the present invention.

Referring now to the drawings, and more particularly to FIGS. 1 and 2, there is shown an embodiment of a threading arm assembly 10 of the present invention used for threading a fiber web tail in a paper machine. Threading arm assembly 10 is positioned in association with a rope nip, such as associated with a drying section in the paper machine, for threading the fiber web tail into the rope nip. Threading arm assembly 10 generally includes a frame 12, elongate member 14, diverter 16 and air assist tube 18.

Frame 12 is positioned along a side of the paper machine and attached to any suitable structure. Frame 12 includes a mounting 20 in the form of a plate with mounting holes therein. Mounting 20 allows threading arm assembly 10 to be mounted to new paper machinery or retrofitted to existing paper machinery. Other types of mountings are of course also possible, depending upon the particular application.

Elongate member 14 is in the form of a cylindrical tube which is carried by frame 12. Cylindrical tube 14 is both longitudinally moveable as well as rotatable relative to frame 12. A handle 22 is attached to cylindrical tube 14 to manually slide and rotate tube 14 relative to frame 12. An adjustable stopper 24 is attached to tube 14 and limits manual movement of tube 14 relative to frame 12.

An adjustable plate assembly 26 is attached to the distal end of cylindrical tube 14. Plate assembly 26 includes a first plate 28 attached to cylindrical tube 14, and a second plate 30 adjustably attached to first plate 28. Suitable fasteners, such as bolts (not shown), are placed within the slotted openings formed in each of first plate 28 and second plate 30 to provide adjustability therebetween.

Diverter 16 is connected with second plate 30 using adjustable bushings 32 providing both longitudinal as well as rotational adjustability. Diverter 16 is placed at a desired orientation within bushings 32, and locked into place such as with set screws or the like.

Diverter 16 has a generally C-shaped cross section. Diverter 16 also has a hollow interior which is in fluid communication with a plurality of air discharge holes 34 at the inner portion of the C-shaped cross section. Air discharge holes 34 generally face toward frame 12. The hollow interior portion of diverter 16 is fluidly connected with hollow tube 14 by a fluid line 36, which in turn is connected with a source of pressurized air at the opposite thereof (not shown).

Air assist tube 18 is also carried by frame 12, and includes a plurality of air discharge holes 38. When in an operating position as shown in FIG. 2, fiber web tail 40 passes between cylindrical tube 14 and air assist tube 18, and moves from left to right as indicated by arrow 42. Air assist tube 18 is coupled with a suitable source of pressurized air, such as the same source to which cylindrical tube 14 is coupled.

During periods of inoperation, cylindrical tube 14 is rotated and retracted such that diverter 16 is rotated upwards and retracted to a position adjacent frame 12 so as not to interfere with operation of the traveling fiber web. If it becomes necessary to thread a fiber web tail, the tail is passed over air assist tube 18 and is urged in the machine direction by the plurality of air discharge holes 38 therein. Cylindrical tube 14 is manually slid to an extended position with handle 22, and rotated downwardly such that diverter 16 is adjacent to the distal end of air assist tube 18. Cylindrical tube 14 is positioned such that the side edge of the fiber web tail passes generally through the inner C-shaped portion of diverter 16. Handle 22 is then pulled in an axial direction to cause diverter 16 to move toward the edge of the fiber web tail. Continued retraction of cylindrical tube 14 and diverter 16 moves the fiber web tail in the transverse direction with respect to the machine or running direction 42.

Figure 3:
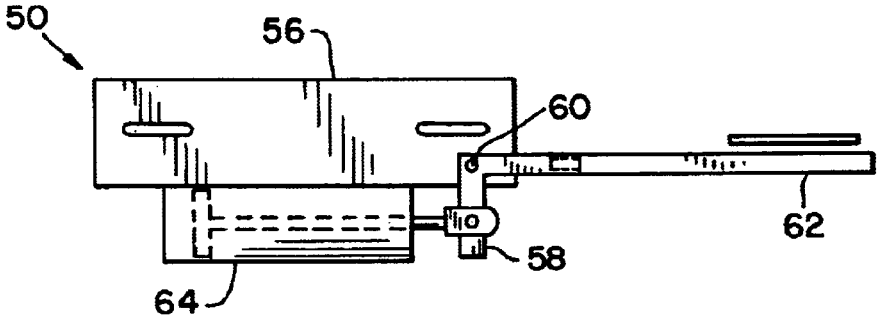
FIG. 3 is a side view of another embodiment of a threading arm assembly of the present invention.
Figure 4:
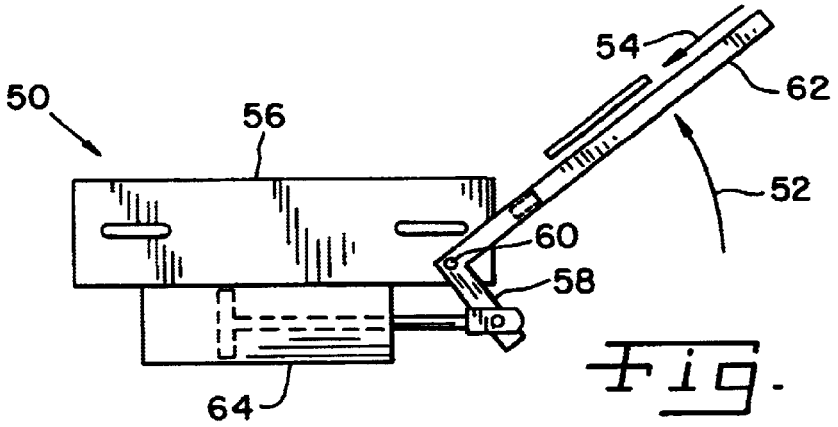
FIG. 4 is a side view of the threading arm assembly of FIG. 3 with the diverter in a pivoted position.

Referring now to FIGS. 3 and 4, there is shown another embodiment of a threading arm assembly 50 of the present invention. In the embodiment shown in FIGS. 3 and 4, fiber web tail 40 is traveling in a direction perpendicular to the drawing page. Threading arm assembly 50, like threading arm assembly 10 shown in FIGS. 1 and 2, moves fiber web tail 40 in a transverse direction with respect to the running or machine direction. However, rather than using a C-shaped diverter with an air cushion as shown in FIG. 1, threading arm assembly 50 includes a pivot arm 62 which pivots as shown by arrow 52 in FIG. 4, thereby causing movement of fiber web tail 40 in a direction transverse to the machine direction as indicated by arrow 54.

More particularly, threading arm assembly 50 includes a mounting 56 which is pivotally coupled with a pivot linkage 58 at pivot pin 60. Pivot arm 62 has a pre-selected length and is in threaded engagement with pivot linkage 58. Pivot linkage 58 has a generally L-shaped configuration, with the free end being coupled with a pneumatic cylinder 64. Pneumatic cylinder 64 is a two way cylinder in the embodiment shown, which is either manually or remotely actuatable. Pneumatic cylinder 64 is of course fluidly coupled with a source of pressurized air (not shown).

Figure 5:
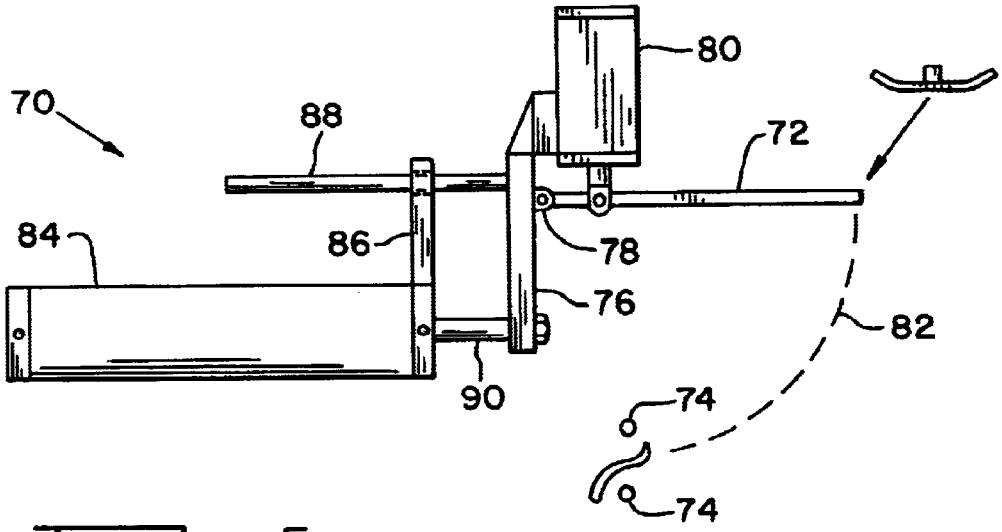
FIG. 5 is a side view of yet another embodiment of a threading arm assembly of the present invention.

FIG. 5 illustrates yet another embodiment of a threading arm assembly 70 of the present invention. Similar to the embodiment of threading arm assembly 50 shown in FIGS. 3 and 4, threading arm assembly 70 shown in FIG. 5 has a pivot arm 72 which is pneumatically actuated. However, rather than pivoting in an upward direction as shown in the embodiment of threading arm assembly 50, pivot arm 72 pivots in a downward direction to move the fiber web tail in a transverse direction with respect to the running direction into ropes 74. Pivot arm 72 may also pivot in an upward direction, depending on the specific application.

More particularly, threading arm assembly 70 includes a frame 76 which is pivotally coupled with pivot arm 72 at pivot pin 78. A pneumatic cylinder 80 is also carried by frame 76. Pneumatic cylinder 80 is a single action, spring loaded air cylinder which pivots pivot arm 72 in a downward direction as shown by phantom line 82 when actuated. An internal spring biases pivot arm 72 to the position shown when pneumatic cylinder 80 is in a non-actuated state.

Stroke cylinder 84 is a pneumatic cylinder which moves frame 76 and pivot arm 72 between operable and non-operable positions. Stroke cylinder 84 is a 2-way cylinder having a guide member 86 which extends therefrom. Frame 76 is coupled with the distal end of ram 90 within stroke cylinder 84. Guide pin 88 extending from frame 76 extends through an opening formed in guide member 86, and maintains the relative positioning between frame 76 and stroke cylinder 84 during extension and retraction of ram 90. Stroke cylinder 84 is coupled with and carried by suitable structure on the paper machine, such as a frame member, etc.

Figure 6:
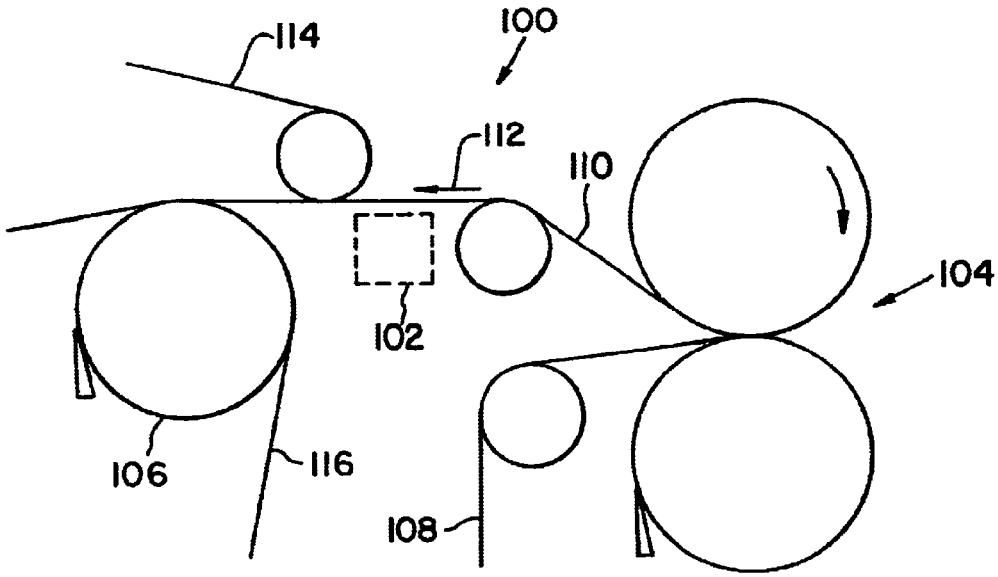
FIG. 6 is a schematic view of a portion of a paper machine, showing relative placement of a threading arm assembly of the present invention.

FIG. 6 is a schematic view of a portion of a paper machine 100, showing relative placement of a threading arm assembly 102 of the present invention. Threading arm assembly 102 could be any of threading arm assemblies 10, 50 or 70 described above, depending upon the particular application. Paper machine 100 includes a press assembly 104 and a dryer cylinder 106. Press assembly 104 includes two press rolls defining a nip therebetween. A felt 108 passes through the press nip formed by press assembly 104 between the two roles, and carries fiber web tail 110. Fiber web tail 110 passes over threading arm assembly 102 and thus it is assumed that threading arm assembly 102 is configured as threading arm assembly 10 or threading arm assembly 50 described above. It will be appreciated, however, that threading arm assembly 102 may likewise be positioned above tail 110, in which case it may take the form of threading arm assembly 70. Regardless of the particular configuration, threading arm assembly 102 moves tail 110 in a transverse direction with respect to machine direction 112 to thread tail 110 into ropes 114 and 116.

Figure 7:
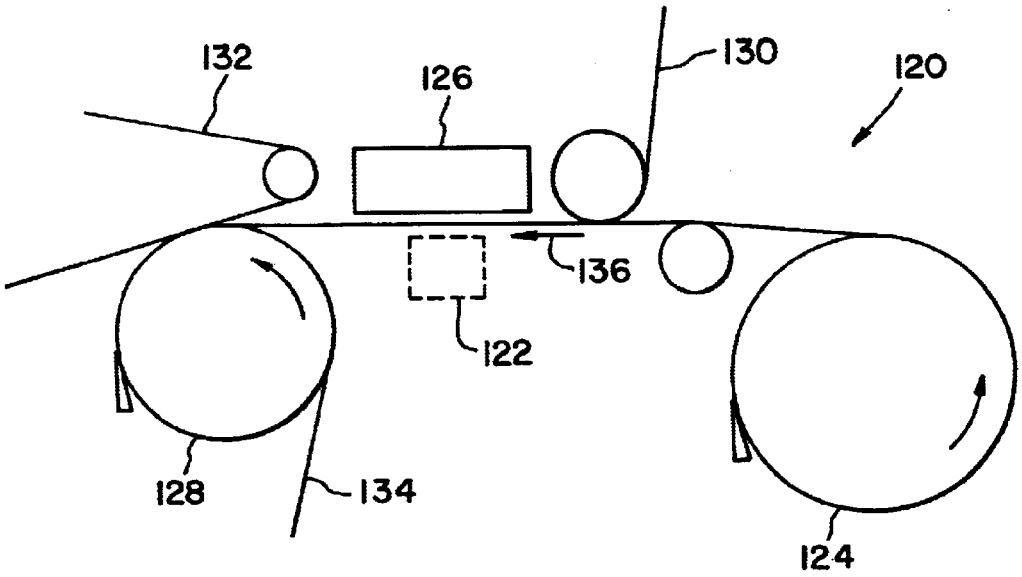
FIG. 7 is a schematic view of a portion of another paper machine, showing relative placement of a threading arm assembly of the present invention.

FIG. 7 is a schematic view of a portion of another embodiment of a paper machine 120, showing relative placement of a threading arm assembly 122. Paper machine 120 includes a center press roll 124, vacuum box 126, baby dryer cylinder 128, felt 130 and ropes 132, 134. Again, threading arm assembly 122 may take the form of threading arm assembly 10, 50 or 70, depending upon the particular application. Threading arm assembly 122 diverts the fiber web tail in a transverse direction with respect to machine direction 136 into the nip formed between ropes 132 and 134.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine for manufacturing a fiber web, the fiber web traveling in a machine direction and having a tail, said paper machine comprising:

at least one rope defining a rope nip;

a threading arm assembly positioned in association with said rope nip, said threading arm assembly including: a frame; and a diverter carried by said frame, said diverter movable to divert the tail in a direction transverse to said machine direction toward said rope nip, said threading arm assembly includes an elongate member carried by and longitudinally movable relative to said frame, said diverter being coupled with said elongate member at an end thereof.

2. The paper machine of claim 1, wherein said elongate member comprises a cylindrical tube which is also rotatable relative to said frame.

3. The paper machine of claim 2, wherein said diverter includes a plurality of air discharge holes facing generally toward said frame, said tube being connected by a fluid line with said diverter.

4. The paper machine of claim 3, wherein said diverter has a generally C-shaped cross section.

5. The paper machine of 3, wherein said threading arm assembly includes an air assist tube with a plurality of air discharge holes facing generally parallel to said machine direction.

6. The paper machine of claim 5, wherein said threading arm assembly carries the tail between said cylindrical tube and said air assist tube.

7. A paper machine for manufacturing a fiber web, the fiber web traveling in a machine direction and having a tail, said paper machine comprising:

at least one rope defining a rope nip;

a threading arm assembly positioned in association with said rope nip, said threading arm assembly including: a frame; and a diverter carried by said frame, said diverter movable to divert the tail in a direction transverse to said machine direction toward said rope nip, said frame includes a mounting and wherein said diverter comprises a pivot arm carried by and pivotally movable relative to said frame, said pivot arm being pivotally movable generally toward said mounting for diverting the fiber web tail generally toward said mounting.

8. The paper machine of claim 7, further including a pneumatic actuator coupled with said pivot arm for pivoting said pivot arm.

9. The paper machine of claim 7, further including a pivot linkage pivotally coupled with said frame, said pivot arm being removably attached to said pivot linkage.

10. A threading arm assembly for threading a fiber web tail, comprising:

a frame having a mounting;

a diverter carried by said frame, said diverter movable generally toward said mounting for diverting the fiber web tail generally toward said mounting.

11. The threading arm of claim 10, wherein said threading arm assembly includes an elongate member carried by and longitudinally movable relative to said frame, said diverter being coupled with said elongate member at an end thereof.

12. The threading arm of claim 11, wherein said elongate member comprises a cylindrical tube which is also rotatable relative to said frame.

13. The threading arm of claim 12, wherein said diverter includes a plurality of air discharge holes facing generally toward said frame, said tube being connected by a fluid line with said diverter.

14. The threading arm of claim 13, wherein said diverter has a generally C-shaped cross section.

15. The threading arm of claim 13, wherein said threading arm assembly includes an air assist tube with a plurality of air discharge holes facing generally parallel to a machine direction.

16. The threading arm of claim 15, wherein said threading arm assembly carries the tail between said cylindrical tube and said air assist tube.

17. The threading arm of claim 10, wherein said diverter comprises a pivot arm carried by and pivotally movable relative to said frame, said pivot arm being pivotally movable generally toward said mounting.

18. The threading arm of claim 17, further including a pneumatic actuator coupled with said pivot arm for pivoting said pivot arm.

19. The threading arm of claim 17, further including a pivot linkage pivotally coupled with said frame, said pivot arm being removably attached to said pivot linkage.

* * * * *